US009888767B1

(12) United States Patent
Gao et al.

(10) Patent No.: US 9,888,767 B1
(45) Date of Patent: Feb. 13, 2018

(54) TOWEL RACK WITH MULTIPLE USAGE MODES

(71) Applicant: Guangzhou Seagull Kitchen And Bath Products Co., Ltd, Guangzhou (CN)

(72) Inventors: Shuqi Gao, Guangzhou (CN); Rongbao Wei, Guangzhou (CN); Chunhua Wu, Guangzhou (CN); Qianfeng Peng, Guangzhou (CN)

(73) Assignee: GUANGZHOU SEAGULL KITCHEN AND BATH PRODUCTS CO., LTD, Guangzhou (CN)

( * ) Notice: Subject to any disclaimer, the term of this patent is extended or adjusted under 35 U.S.C. 154(b) by 0 days.

(21) Appl. No.: 15/643,342

(22) Filed: Jul. 6, 2017

(30) Foreign Application Priority Data

Nov. 7, 2016 (CN) ..... 2016 1 09781496
Nov. 7, 2016 (CN) ..... 2016 2 12018462

(51) Int. Cl.

| | |
|---|---|
| ***A47G 25/00*** | (2006.01) |
| ***A47F 5/00*** | (2006.01) |
| ***A47B 96/02*** | (2006.01) |
| ***A47B 43/00*** | (2006.01) |
| ***A47K 10/04*** | (2006.01) |
| ***A47G 25/06*** | (2006.01) |

(52) U.S. Cl.
CPC ..... *A47B 43/00* (2013.01); *A47F 5/00* (2013.01); *A47G 25/0685* (2013.01); *A47K 10/04* (2013.01)

(58) Field of Classification Search
CPC .... A47K 10/04; A47K 10/10; A47G 25/0685; A47F 5/01; A47B 43/00; A47B 96/025
See application file for complete search history.

(56) References Cited

U.S. PATENT DOCUMENTS 1,995,656 A * 3/1935 Stout ..... B60R 7/043 108/45
2,249,234 A * 7/1941 Srodulski ..... G07F 9/10 211/149
2,259,166 A * 10/1941 Kendrick ..... A47K 10/04 211/123
2,411,320 A * 11/1946 Dunn ..... A47G 25/746 211/100
2,517,385 A * 8/1950 Clark ..... F25D 25/02 108/134

(Continued)

*Primary Examiner* — Daniel J Troy
*Assistant Examiner* — Kimberly S Wright
(74) *Attorney, Agent, or Firm* — CBM Patent Consulting, LLC

(57) ABSTRACT

A towel rack with multiple usage modes, comprising: first connecting rod; second connecting rod; pair of large skeletons, first upper rod of left side large skeleton and right side large skeleton connecting to first connecting rod by first, second rotation positioning member, respectively, pair of large skeletons and first connecting rod being in relative rotation state or locked state when pressing or releasing first button; pair of small skeletons, second upper rod of left side small skeleton connecting to first lower rod of left side large skeleton, and second upper rod of right side small skeleton connecting to first lower rod of right side large skeleton through third and fourth rotation positioning member, respectively, pair of small skeletons and large skeletons being in relative rotation state when pressing second button.

8 Claims, 9 Drawing Sheets

(56) References Cited

U.S. PATENT DOCUMENTS 3,429,546 A * 2/1969 Porter ..... G09F 7/20 211/104
3,625,371 A * 12/1971 Dill ..... A47B 96/025 108/90
4,323,162 A * 4/1982 Steinhilber ..... A47G 25/0685 211/100
4,877,164 A * 10/1989 Baucom ..... B60N 3/101 16/341
6,105,795 A * 8/2000 Terragni ..... A47G 25/02 211/100
6,318,684 B1 * 11/2001 Ireland ..... A47F 5/0068 108/77
6,378,818 B1 * 4/2002 Padiak ..... G09F 7/22 248/201
6,434,871 B2 * 8/2002 Conway ..... G09F 3/204 40/642.02
6,536,079 B2 * 3/2003 Hill ..... A47C 4/20 108/168
6,665,969 B1 * 12/2003 Conway ..... G09F 3/204 40/605
6,726,036 B2 * 4/2004 Koellner ..... D06F 57/12 211/104
6,796,064 B2 * 9/2004 Gibson ..... G09F 7/22 40/606.15
6,845,870 B2 * 1/2005 Yang ..... A47K 10/04 211/104
7,014,280 B2 * 3/2006 Borgen ..... A47B 46/005 108/109
7,946,434 B1 * 5/2011 Greenspon ..... A47G 25/0685 211/195
D650,263 S * 12/2011 Barrese ..... D8/376
2007/0062891 A1 * 3/2007 Stievenard ..... A47B 96/025 211/59.2
2013/0160273 A1 * 6/2013 Schuetz ..... A47F 5/0876 29/428
2016/0088933 A1 * 3/2016 Rossignol ..... A47B 81/007 312/270.2

* cited by examiner

TOWEL RACK WITH MULTIPLE USAGE MODES

This application claims priority to Chinese Patent Application Ser. No. CN2016109781496 filed 7 Nov. 2016 and CN2016212018462 filed 7 Nov. 2016.

TECHNICAL FIELD

The present invention relates to a towel rack, in particular to a towel rack with multiple usage modes.

BACKGROUND

In daily life, in order to facilitate packaging and using of products, some folding positioning towel racks are usually used in a smaller bathroom, so that products can be folded in the non-use state to reduce space occupied by them, and to facilitate placing, packaging and using.

Currently, the relative angle between the folding positioning towel rack and the wall is 0 degree or 90 degrees on the market, the towel rack is sheathed in the groove or through hole in the wall through the shaft on the two ends thereof to achieve rotation, and in addition to, the wall is provided with positioning platform to limit rotation and sagging of the towel rack. However, in the use of the process, adjustable angle of the towel rack is limited, and will fall to hit people in non-use state of folding without restrictions against the wall.

It is necessary to develop a new folding positioning towel bar to improve its performance, and to meet people's daily needs.

DESCRIPTION

In view of drawbacks of the prior art, the present invention provides a towel rack with multiple usage modes, which can be quickly adjusted and locked, and has advantages of multi-angle adjustment, simple processing and assembling, convenient and labor-saving adjustment, beautiful appearance, and high safety performance.

The technical solution of the present invention is summarized as follows:

A towel rack with multiple usage modes, comprising:

A first connecting rod;

A second connecting rod;

A pair of large skeletons, each large skeleton including a first upper rod and a first lower rod, wherein the first upper rod of the left side large skeleton is connected to the left side of the first connecting rod by a first rotation positioning member, and the first upper rod of the right side large skeleton is connected to the right side of the first connecting rod through a second rotation positioning member, and wherein both ends of the left side large skeleton are penetrated. A first button is provided in the inside of the left side large skeleton. And the first button is arranged in such a manner that the pair of large skeletons and the first connecting rod are in a state in which relative rotation can occur when the first button are pressed, and the pair of large skeletons is in a locked state with the first connecting rod when the first button is released;

A pair of small skeletons, each small skeleton including a second upper rod and a second lower rod, wherein the second upper rod of the left side small skeleton is connected to the left side of the first lower rod of the left side large skeleton by a third rotation positioning member, and the second upper rod of the right side small skeleton is connected to the right side of the first lower rod of the right side large skeleton through a fourth rotation positioning member, and the second connecting rod is fixedly connected between the second lower rod of the pair of small skeletons. Wherein both ends of the left side small skeleton are penetrated. A second button is provided in the inside of the left side small skeleton. And the first button is arranged in such a manner that the pair of small skeletons and the pair of large skeletons are in a state in which relative rotation can occur when the second button are pressed, and the pair of small skeletons is in a locked state with the pair of large skeletons when the second button is released.

Preferably, the towel rack with multiple usage modes, wherein the first rotation positioning member contains:

A first tooth formed on an inner wall of the first connecting rod;

A second tooth formed on an inner wall of the first upper rod of the left side large skeleton;

A first screw hole formed in the interior of the first connecting rod;

A first connecting screw having one end extending into the inside of the first upper rod of the left side large skeleton and the other end threadedly connecting to the first screw hole;

A first positioning wheel slidably fitted on the first connecting screw, and the first positioning wheel having a third tooth engaging with the first tooth and the second tooth, the first positioning wheel abuting against the first button;

A first return spring sheathed on the first connecting screw, one end of the first return spring connecting to the first positioning wheel and the other end connecting to the inner wall of the first connecting rod;

The second rotation positioning member comprising:

A second screw hole formed in the interior of the first upper rod of the right side large skeleton;

A first limit screw having one end extending into the interior of the first connecting rod and the other end threadedly connecting to the second screw hole;

A first cam having a first end face tooth, a first concave wheel having a second end face tooth, the first cam and the first concave wheel being engaged with each other, and the first cam and the first concave wheel slidably fitting on the first limit screw, wherein the first cam is provided in the first connecting rod, and the first concave wheel is disposed inside the first upper rod of the right side large skeleton;

A second return spring which is sheathed on the first limit screw, and has one end connecting to the first concave wheel and the other end connecting to the first upper rod of the right side large skeleton;

When the first button is pressed, the first positioning wheel moves in the direction of the first connecting rod until separating from the second tooth so that the left side large skeleton and the first connecting rod are in a state in which relative rotation can occur, and the first concave wheel moves in the direction of the right side large skeleton by the action of the first connecting rod so that the first concave wheel and the first cam are disengaged from each other, so that the right side large skeleton and the first connecting rod are in a state in which relative rotation can occur;

When the first button is released, the first positioning wheel moves in the direction of the left side large skeleton by the elastic force of the first return spring until it is simultaneously engaged with the first tooth and the second tooth, so that the left side large skeleton is in a locked state with the first connecting rod, and the first concave wheel moves in the direction of the first connecting rod by the elastic force of the second return spring until the first concave wheel and the first cam are engaged with each other so that the right side large skeleton is in a locked state with the first connecting rod.

Preferably, the towel rack with multiple usage modes, the third rotation positioning member contains:

A fourth tooth formed on an inner wall of the second upper rod of the left side small skeleton;

A fifth tooth formed on an inner wall of the first lower rod of the left side large skeleton;

A third screw hole formed in the interior of the second upper rod of the left side small skeleton;

A second connecting screw having one end extending into the inside of the first lower rod of the left side large skeleton and the other end threadedly connecting to the third screw hole;

A second positioning wheel slidably fitted on the second connecting screw, and the second positioning wheel having a sixth tooth engaging with the fourth tooth and the fifth tooth, the second positioning wheel abuting against the second button;

A third return spring sheathed on the second connecting screw, one end of the third return spring connecting to the second positioning wheel and the other end connecting to an inner wall of the first lower rod of the left side large skeleton;

The fourth rotation positioning member comprising:

A fourth screw hole formed in the interior of the second upper rod of the right side small skeleton;

A second limit screw having one end extending into the interior of the first lower rod of the right side large skeleton and the other end threadedly connecting to the fourth screw hole;

A second cam having a third end face tooth, a second concave wheel having a fourth end face tooth, the second cam and the second concave wheel being engaged with each other, and the second cam and the second concave wheel slidably fitting on the second limit screw, wherein the second cam is provided in the right side large skeleton, and the second concave wheel is disposed inside the second upper rod of the right side small skeleton;

A fourth return spring which is sheathed on the second limit screw, and has one end connecting to the second concave wheel and the other end connecting to the second upper rod of the right side small skeleton;

When the second button is pressed, the second positioning wheel moves in the direction of the left side large skeleton until separating from the fifth tooth so that the left side large skeleton and the left side small skeleton are in a state in which relative rotation can occur, and the second concave wheel moves in the direction of the right side small skeleton by the action of the second connecting rod so that the second concave wheel and the second cam are disengaged from each other, so that the right side large skeleton and the right side small skeleton are in a state in which relative rotation can occur;

When the second button is released, the second positioning wheel moves in the direction of the left side small skeleton by the elastic force of the third return spring until it is simultaneously engaged with the fourth tooth and the fifth tooth, so that the left side large skeleton is in a locked state with the left side small skeleton, and the second concave wheel moves in the direction of the right side large skeleton by the elastic force of the fourth return spring until the second concave wheel and the second cam are engaged with each other so that the right side large skeleton is in a locked state with the right side small skeleton.

Preferably, the towel rack with multiple usage modes, wherein the outer circumference of the first positioning wheel is annularly arranged with eight third teeth, and the outer circumference of the second positioning wheel is annularly arranged with eight sixth teeth, and the right end face of the first cam having eight first end face teeth with an annular arrangement, the left end face of the first concave wheel having eight second end face teeth with an annular arrangement, the right end face of the second cam having eight third end face teeth with an annular arrangement, and the right end face of the second concave wheel having eight fourth end face teeth with an annular arrangement.

Preferably, the towel rack with multiple usage modes, wherein the left end face of the first cam has four annularly arranged first convex feet, the left end face of the second cam has four annularly arranged second convex feet, the right end face of the first concave wheel has four annularly arranged third convex feet, and the right end face of the second concave wheel has four annularly arranged fourth convex feet; the interior of the first connecting rod having four annularly arranged first grooves, the interior of the first upper rod of the right side large skeleton having four annularly arranged second grooves, the interior of the first lower rod of the right side large skeleton having four annularly arranged third grooves, the interior of the second upper rod of the right side small skeleton having four annularly arranged fourth grooves; wherein the first convex feet and the first grooves are fixed to each other, the second convex feet and the second grooves are fixed to each other, the third convex feet and the third grooves are fixed to each other, and the fourth convex feet and the fourth grooves are fixed to each other.

Preferably, the towel rack with multiple usage modes, wherein the first button includes a first body and four fifth convex feet connected to the right side of the first body, and when the first button is pressed, the fifth convex feet sliding along a through groove opened on the inside of the left side large skeleton, and the fifth convex feet abutting against the first positioning wheel, the second button including a second body and four sixth convex feet connected to the right side of the second body, and when the second button is pressed, the sixth convex feet sliding along a through groove opened on the inside of the left side small skeleton, and the sixth convex feet abutting against the second positioning wheel.

Preferably, the towel rack with multiple usage modes, also contains:

A first nut provided at the left end of the first upper rod of the left side large skeleton for stopping the first button, A second nut provided at the left end of the second upper rod of the left side small skeleton for stopping the second button.

Preferably, the towel rack with multiple usage modes, the first limit screw is sheathed with a first opening gasket opening a first arcuate groove, the opening direction of the first arcuate groove being directed toward the left, a first fastening bolt being connected to the first upper rod of the right side large skeleton and passing upwardly through the first arcuate groove; the second limit screw being sheathed with a second opening gasket opening a second arcuate groove, the opening direction of the second arcuate groove being directed toward the left, a second fastening bolt being connected to the second upper rod of the right side small skeleton and passing upwardly through the second arcuate groove.

Preferably, the towel rack with multiple usage modes, wherein the left side large skeleton, the left side small skeleton, the right side large skeleton, and the right side small skeleton are integrally formed.

The towel rack with multiple usage modes of the present invention uses the first button to control mutual loosening and locking between the left side large skeleton and the first connecting rod, and the second button is used to control mutual loosening and locking between the left side small skeleton and the left side large skeleton. The towel rack can form a variety of angles and states. The present invention has the advantages of quick adjustment and locking, multi-angle adjustment, easy processing and assembling, convenient and easy adjustment, beautiful appearance, high safety performance and difficult to fail.

BRIEF DESCRIPTION OF THE DRAWINGS

FIG. 13(*b*) is a part view of the first concave wheel of the towel rack with multiple usage modes of the present invention.

DETAILED DESCRIPTION

Figure 1:
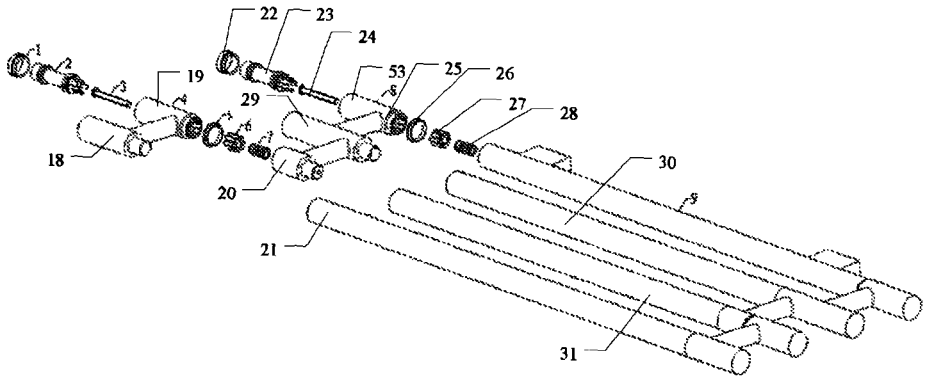
FIG. 1 is an assembly exploded view of the left side of the towel rack with multiple usage modes of the present invention.

The present invention will now be described in further detail with reference to the accompanying drawings as required:

As shown in FIG. 1 to FIG. 7, the present invention provides a towel rack with multiple usage modes, comprising: a first connecting rod 9, a second connecting rod 21; a pair of large skeletons, each large skeleton including a first upper rod and a first lower rod, wherein the first upper rod 53 of the left side large skeleton 8 is connected to the left side of the first connecting rod 9 by a first rotation positioning member, and the first upper rod 32 of the right side large skeleton 16 is connected to the right side of the first connecting rod 9 through a second rotation positioning member, and wherein both ends of the left side large skeleton 8 are penetrated. A first button 23 is provided in the inside of the left side large skeleton 8. And the first button 23 is arranged in such a manner that the pair of large skeletons and the first connecting rod 9 are in a state in which relative rotation can occur when the first button 23 are pressed, and the pair of large skeletons is in a locked state with the first connecting rod 9 when the first button 23 is released; a pair of small skeletons, each small skeleton including a second upper rod and a second lower rod 18, 41, wherein the second upper rod 19 of the left side small skeleton 4 is connected to the left side of the first lower rod 20 of the left side large skeleton 8 by a third rotation positioning member, and the second upper rod 42 of the right side small skeleton 17 is connected to the right side of the first lower rod 34 of the right side large skeleton 16 through a fourth rotation positioning member, and the second connecting rod 21 is fixedly connected between the second lower rod 18, 41 of the pair of small skeletons. Wherein both ends of the left side small skeleton 4 are penetrated. A second button 2 is provided in the inside of the left side small skeleton 4. And the first button 23 is arranged in such a manner that the pair of small skeletons and the pair of large skeletons are in a state in which relative rotation can occur when the second button 2 are pressed, and the pair of small skeletons is in a locked state with the pair of large skeletons when the second button 2 is released.

The present invention uses the first button 23 to control mutual loosening and locking between the left side large skeleton 8 and the first connecting rod 9, and the second button 2 is used to control mutual loosening and locking between the left side small skeleton 4 and the left side large skeleton 8. Specifically, when the first button 23 is pressed, the first rotation positioning member between the left side large skeleton 8 and the first connecting rod 9, and the second rotation positioning member between the right side large skeleton 16 and the first connecting rod 9 are operated, so that the left side large skeleton 8 and the first connecting rod 9 can be rotated relative to each other, and the right side large skeleton 16 and the first connecting rod 9 can also be rotated relative to each other and rotated to an appropriate angle; when the first button 23 is released, the first rotation positioning member between the left side large skeleton 8 and the first connecting rod 9, and the second rotation positioning member between the right side large skeleton 16 and the first connecting rod 9 are operated, so that the left side large skeleton 8 and the first connecting rod 9 can not be rotated relative to each other, the right side large skeleton 16 and the first connecting rod 9 can also not be rotated relative to each other, and the three are locked in the current position. Similarly, the angle adjustment and locking between the left side small skeleton 4 and the left side large skeleton 8 is achieved by controlling the second button 2, and the angle adjustment and locking process is consistent with the above process, and finally the left side small skeleton 4 and the left side large skeleton 8 to form a specific angle, and then meeting the needs of different situations.

In order to increase convenience for use, placing more items, the left side large skeleton 8 and the right side large skeleton 16 may also be provided with intermediate rods 29, 33, respectively, and the two intermediate rods 29, 33 are fixedly connected to a third connecting rod 30. A fourth connecting rod 31 is fixedly connected between the first lower rod 20 of the left side large skeleton 8 and the first lower rod 34 of the right side large skeleton 16.

Figure 2:
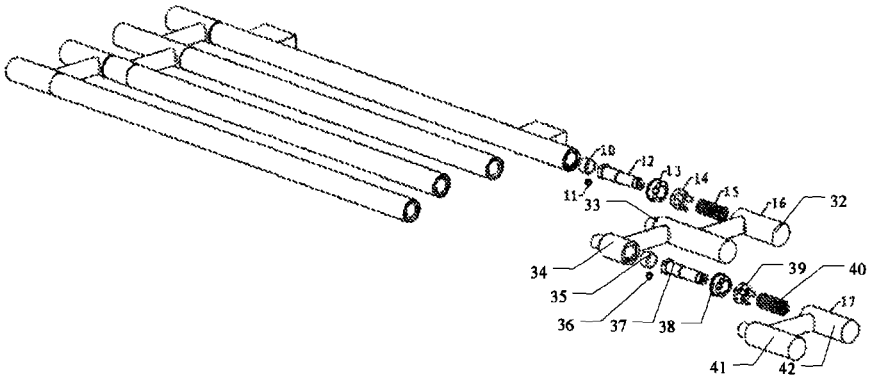
FIG. 2 is an assembly exploded view of the right side of the towel rack with multiple usage modes of the present invention.
Figure 9:
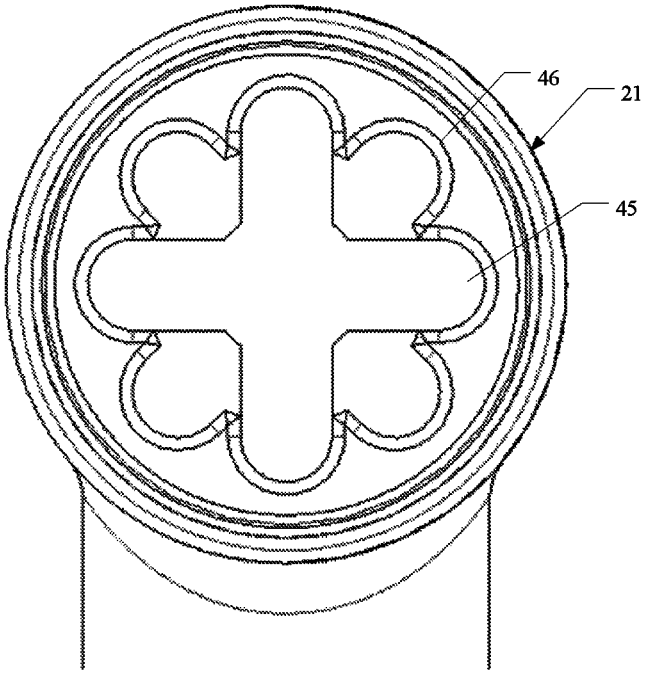
FIG. 9 is a partial view of the second tooth and the through groove of the first upper rod of the left side large skeleton of the towel rack with multiple usage modes of the present invention.
Figure 10:
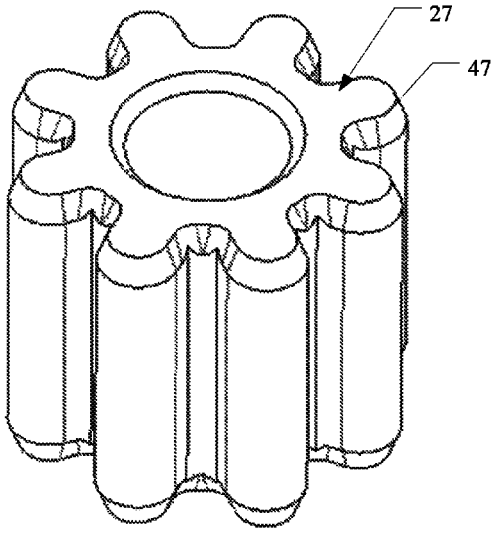
FIG. 10 is a part view of the first positioning wheel of the towel rack with multiple usage modes of the present invention.

As shown in FIG. 1 and FIG. 2, in a preferred embodiment, the towel rack with multiple usage modes, wherein the first rotation positioning member contains a first tooth formed on an inner wall of the first connecting rod 9; a second tooth 46 formed on an inner wall of the first upper rod 53 of the left side large skeleton 8 (as shown in FIG. 9 and FIG. 10); a first screw hole formed in the interior of the first connecting rod 9; a first connecting screw 24 having one end extending into the inside of the first upper rod 53 of the left side large skeleton 8 and the other end threadedly connecting to the first screw hole; a first positioning wheel 27 slidably fitted on the first connecting screw 24, and the first positioning wheel 27 having a third tooth 47 engaging with the first tooth and the second tooth 46, the first positioning wheel 27 abuting against the first button 23; a first return spring 28 sheathed on the first connecting screw 24, one end of the first return spring connecting to the first positioning wheel 27 and the other end connecting to the inner wall of the first connecting rod 9; the second rotation positioning member comprising: a second screw hole formed in the interior of the first upper rod 32 of the right side large skeleton 16; a first limit screw 12 having one end extending into the interior of the first connecting rod 9 and the other end threadedly connecting to the second screw hole; a first cam 13 having a first end face tooth 49, a first concave wheel 14 having a second end face tooth 51, the first cam 13 and the first concave wheel 14 being engaged with each other, and the first cam 13 and the first concave wheel 14 slidably fitting on the first limit screw 12, wherein the first cam 13 is provided in the first connecting rod 9, and the first concave wheel 14 is disposed inside the first upper rod 32 of the right side large skeleton 16; a second return spring 15 which is sheathed on the first limit screw 12, and has one end connecting to the first concave wheel 14 and the other end connecting to the first upper rod 32 of the right side large skeleton 16. When the first button 23 is pressed, the first positioning wheel 27 moves in the direction of the first connecting rod 9 until separating from the second tooth 46 so that the left side large skeleton 8 and the first connecting rod 9 are in a state in which relative rotation can occur, and the first concave wheel 14 moves in the direction of the right side large skeleton 16 by the action of the first connecting rod 9 so that the first concave wheel 14 and the first cam 13 are disengaged from each other, so that the right side large skeleton 16 and the first connecting rod 9 are in a state in which relative rotation can occur. When the first button 23 is released, the first positioning wheel 27 moves in the direction of the left side large skeleton 8 by the elastic force of the first return spring 28 until it is simultaneously engaged with the first tooth and the second tooth 46, so that the left side large skeleton 8 is in a locked state with the first connecting rod 9, and the first concave wheel 14 moves in the direction of the first connecting rod 9 by the elastic force of the second return spring 15 until the first concave wheel 14 and the first cam 13 are engaged with each other so that the right side large skeleton 16 is in a locked state with the first connecting rod 9.

In a preferred embodiment, the towel rack with multiple usage modes, the third rotation positioning member contains: a fourth tooth formed on an inner wall of the second upper rod 19 of the left side small skeleton 4; a fifth tooth formed on an inner wall of the first lower rod 20 of the left side large skeleton 8; a third screw hole formed in the interior of the second upper rod 19 of the left side small skeleton 4; a second connecting screw having one end extending into the inside of the first lower rod 20 of the left side large skeleton 8 and the other end threadedly connecting to the third screw hole; a second positioning wheel 6 slidably fitted on the second connecting screw 3, and the second positioning wheel 6 having a sixth tooth engaging with the fourth tooth and the fifth tooth, the second positioning wheel 6 abuting against the second button 2; a third return spring 7 sheathed on the second connecting screw 3, one end of the third return spring 7 connecting to the second positioning wheel 6 and the other end connecting to an inner wall of the first lower rod 20 of the left side large skeleton 8; the fourth rotation positioning member comprising: a fourth screw hole formed in the interior of the second upper rod 42 of the right side small skeleton 17; a second limit screw 37 having one end extending into the interior of the first lower rod 34 of the right side large skeleton 16 and the other end threadedly connecting to the fourth screw hole; a second cam 38 having a third end face tooth, a second concave wheel 39 having a fourth end face tooth, the second cam 38 and the second concave wheel 39 being engaged with each other, and the second cam 38 and the second concave wheel 39 slidably fitting on the second limit screw 37, wherein the second cam 38 is provided in the right side large skeleton 16, and the second concave wheel 39 is disposed inside the second upper rod 42 of the right side small skeleton 17; a fourth return spring 40 which is sheathed on the second limit screw 37, and has one end connecting to the second concave wheel 39 and the other end connecting to the second upper rod 42 of the right side small skeleton 17. When the second button 2 is pressed, the second positioning wheel 6 moves in the direction of the left side large skeleton 8 until separating from the fifth tooth so that the left side large skeleton 8 and the left side small skeleton 4 are in a state in which relative rotation can occur, and the second concave wheel 39 moves in the direction of the right side small skeleton 17 by the action of the second connecting rod 21 so that the second concave wheel 39 and the second cam 38 are disengaged from each other, so that the right side large skeleton 16 and the right side small skeleton 17 are in a state in which relative rotation can occur. When the second button 2 is released, the second positioning wheel 6 moves in the direction of the left side small skeleton 4 by the elastic force of the third return spring 7 until it is simultaneously engaged with the fourth tooth and the fifth tooth, so that the left side large skeleton 8 is in a locked state with the left side small skeleton 4, and the second concave wheel 39 moves in the direction of the right side large skeleton 16 by the elastic force of the fourth return spring 40 until the second concave wheel 39 and the second cam 38 are engaged with each other so that the right side large skeleton 16 is in a locked state with the right side small skeleton 17.

In fact, the first rotation positioning member and the third rotation positioning member have the same structure, and operation principle and operation mode are the same. The second rotation positioning member and the fourth rotation positioning member have the same structure, and operation principle and operation mode are the same. The angle adjustment process of the towel skeleton according to the present invention will be described with reference to the third rotation positioning member and the fourth rotation positioning member.

Figure 3:
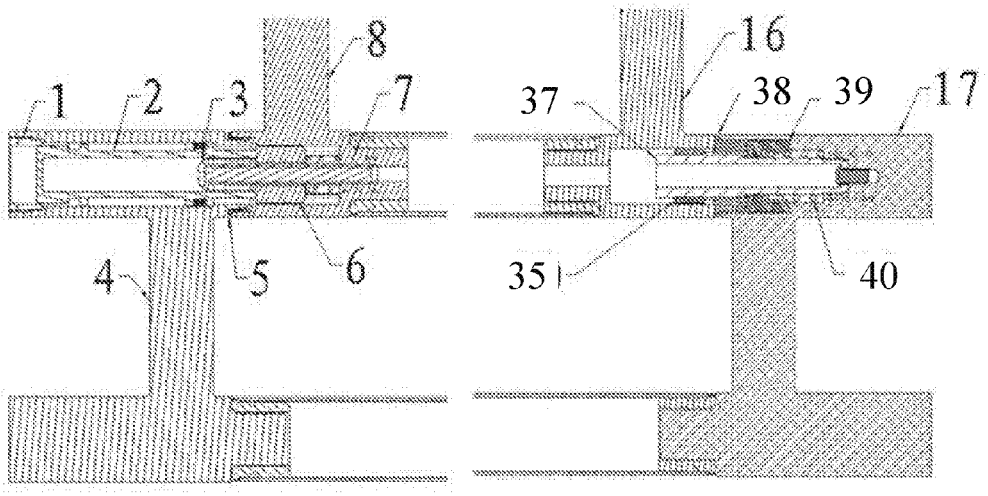
FIG. 3 is a sectional view of a first rotation position of the towel rack with multiple usage modes of the present invention (the relative angle of the left side small skeleton and the left side large skeleton is 0 degree, and the second button is pressed)
Figure 4:
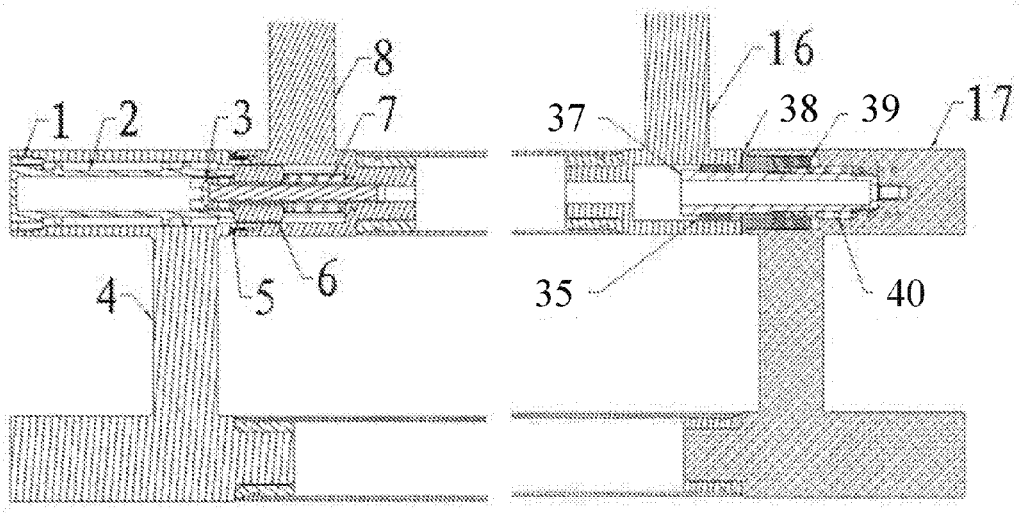
FIG. 4 is a sectional view of a first rotation position of the towel rack with multiple usage modes of the present invention (the relative angle of the left side small skeleton and the left side large skeleton is 0 degree, and the second button is released)

As shown in FIG. 3 and FIG. 4, the FIG. 3 shows a sectional view of the towel rack when the second button is pressed, and the FIG. 4 shows a sectional view of the towel rack when the second button is released. In the FIG. 3 and FIG. 4, the relative angle of the left side large skeleton 8 and the left side small skeleton 4 is 0 degree, similarly, the relative angle of the right side large skeleton 16 and the right side small skeleton 17 is also 0 degree.

When the second button 2 is pressed, the second button 2 urges the second positioning wheel to overcome the elastic force of the third return spring 7 and to move in the direction toward the left side large skeleton 8 so that the sixth tooth of the second positioning wheel is disengaged from the fourth tooth of the second upper rod 19 of the left side small skeleton 4, at this time the left side small skeleton 4 and the left side large skeleton 8 are in a state in which relative rotation can occur. The second concave wheel 39 overcomes the elasticity of the fourth return spring 40 and moves in the direction toward the right side small skeleton 17 by the power transmission of the second connecting rod 21 so that the fourth end face tooth of the second concave wheel 39 and the third end face tooth of the second cam 13 are disengaged from each other, at this time the right side small skeleton 17 and the right side large skeleton 16 are in a state in which relative rotation can occur. In this embodiment, the relative angle of the left side small skeleton 4 and the left side large skeleton 8 is 0 degree, that is, the left side small skeleton 4 is rotated to open both, and the second positioning wheel rotates together with the left side large skeleton 8. When the left side small skeleton 4 is driven, the right side small skeleton 17 is engaged with the left side small skeleton 4 by the second connecting rod 21, and the rotation angle thereof coincides with the left side small skeleton 4. Similarly, when the left side large skeleton 8 is rotated, the right side large skeleton 16 is engaged with the left side large skeleton 8 by the first connecting rod 9, and the rotation angle thereof is also coincident with the left side large skeleton 8.

When the second button 2 is released, the second positioning wheel moves in the direction toward the left side small skeleton 4 by the elastic force of the third return spring 7 so that the sixth tooth of the second positioning wheel is engaged again with the fourth tooth of the second upper rod 19 of the left side small skeleton 4. When the second button 2 is completely released, the sixth tooth is completely engaged with the fourth tooth. The second positioning wheel presses the second upper rod 19 of the left side small skeleton 4 by the elastic force of the third return spring, and the left side small skeleton 4 and the left side large skeleton 8 are locked at the adjusted relative angle. By the power transmission of the second connecting rod 21, the second concave wheel 39 moves in the direction toward the right side large skeleton 16 by the elastic force of the fourth return spring 40 so that the fourth end face tooth of the second concave wheel 39 and the third end face tooth the second cam 38 are again engaged with each other, and the right side small skeleton 17 is fixed at the adjusted relative angle. In this embodiment, the relative angle of the left side small skeleton 4 and the left side large skeleton 8 is 0 degree, and the left side small skeleton 4 and the left side large skeleton 8 are completely opened into a plane, while the right side small skeleton 17 and the right side large skeleton 16 are also fully opened on a plane.

It is also clear from this embodiment that the relative angle of the left side large skeleton 8 and the first connecting rod 9 can be adjusted to 0 degree by the same operation, and of course, the relative angles of the right side large skeleton 16 and the first connecting rod 9 is also 0 degree (seeing FIG. 1 and FIG. 2 for this status).

Figure 13A:
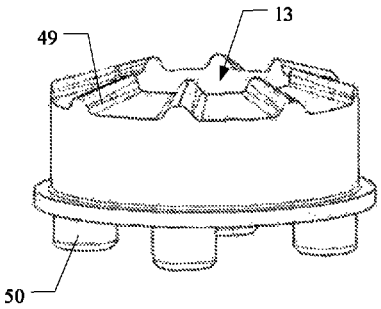
FIG. 13(*a*) is a part view of the first cam of the towel rack with multiple usage modes of the present invention.
Figure 13B:
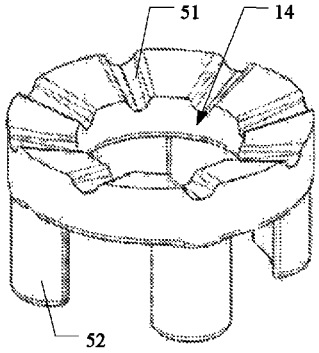

In a preferred embodiment, the towel rack with multiple usage modes, the outer circumference of the first positioning wheel 27 is annularly arranged with eight third teeth 47 (seeing FIG. 10), and the outer circumference of the second positioning wheel 6 is annularly arranged with eight sixth teeth, and the right end face of the first cam 13 having eight first end face teeth 49 with an annular arrangement, the left end face of the first concave wheel 14 having eight second end face teeth 51 with an annular arrangement (seeing FIGS. 13(*a*) and 13(*b*)), the right end face of the second cam 38 having eight third end face teeth with an annular arrangement, and the right end face of the second concave wheel 39 having eight fourth end face teeth with an annular arrangement.

Figure 5:
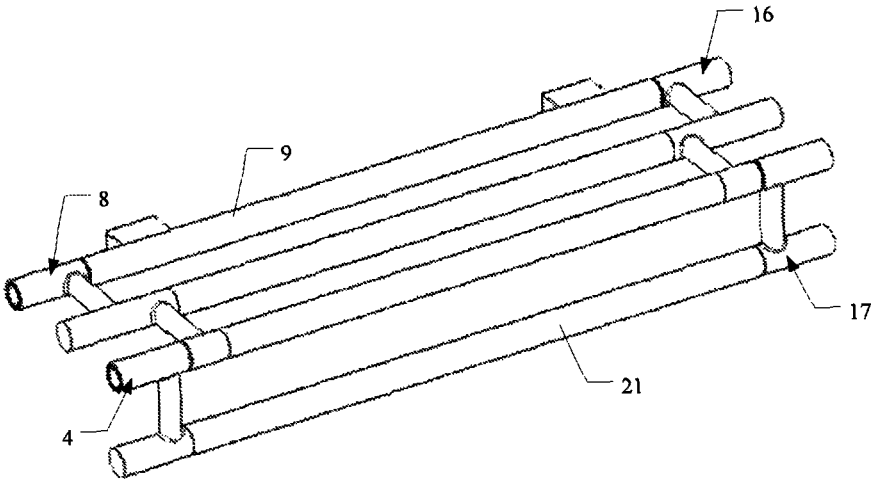
FIG. 5 is a morphology view of a second rotation position of the towel rack with multiple usage modes of the present invention (the relative angle of the left side small skeleton and the left side large skeleton is 90 degrees, and the relative angle of the left side large skeleton and the first connecting rod is 0 degree)

As shown in FIG. 5, the FIG. 5 shows the case where the relative angle of the left side large skeleton 8 and the left side small skeleton 4 is 0 degree. The process is: when the second button 2 is pressed, the second button 2 urges the second positioning wheel to overcome the elastic force of the third return spring 7 and to move in the direction toward the left side large skeleton 8 so that the sixth tooth of the second positioning wheel is disengaged from the fourth tooth of the second upper rod 19 of the left side small skeleton 4, at this time the left side small skeleton 4 and the left side large skeleton 8 are in a state in which relative rotation can occur. The second concave wheel 39 overcomes the elasticity of the fourth return spring 40 and moves in the direction toward the right side small skeleton 17 by the power transmission of the second connecting rod 21 so that the fourth end face tooth of the second concave wheel 39 and the third end face tooth of the second cam 38 are disengaged from each other, at this time the right side small skeleton 17 and the right side large skeleton 16 are in a state in which relative rotation can occur. At this time, adjusting the left side small skeleton 4 to desired angle. In this embodiment, the relative angle of the left side small skeleton 4 and the left side large skeleton 8 is 90 degrees, that is, the left side small skeleton 4 is rotated so that the relative angle between the two is 90 degrees.

Since the fourth tooth of the left side small skeleton 4 and the sixth tooth of the second positioning wheel have eight, each engaging one tooth, the relative angle is 45 degrees, so that the left side small skeleton 4 is rotated by an angle of two the fourth tooth, and the relative angle of the left side large skeleton 8 and the left side small skeleton 4 can be reached 90 degrees. At this time, the second positioning wheel rotates together with the left side large skeleton 8.

When the second button 2 is released, the second positioning wheel moves in the direction toward the left side small skeleton 4 by the elastic force of the third return spring 7 so that the sixth tooth of the second positioning wheel is engaged again with the fourth tooth of the second upper rod 19 of the left side small skeleton 4. When the second button 2 is completely released, the sixth tooth is completely engaged with the fourth tooth. The second positioning wheel presses the second upper rod 19 of the left side small skeleton 4 by the elastic force of the third return spring 7, and the left side small skeleton 4 and the left side large skeleton 8 are locked at the adjusted relative angle. By the power transmission of the second connecting rod 21, the second concave wheel 39 14 moves in the direction toward the right side large skeleton 16 by the elastic force of the fourth return spring 40 so that the fourth end face tooth of the second concave wheel 39 and the third end face tooth the second cam 38 are again engaged with each other, and the right side small skeleton 17 is fixed at the adjusted relative angle. In this embodiment, the relative angle of the left side small skeleton 4 and the left side large skeleton 8 is 90 degrees, and the left side small skeleton 4 and the left side large skeleton 8 are locked at positions where the relative angle is 90 degrees. Similarly, the left side large skeleton 8 and the first connecting rod 9 are also locked at positions where the relative angle is 0 degree.

Figure 6:
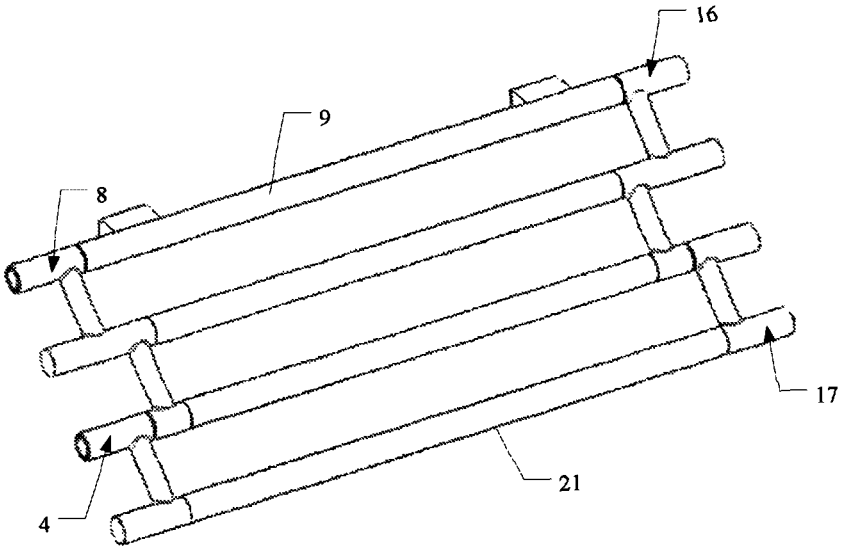
FIG. 6 is a morphology view of a third rotation position of the towel rack with multiple usage modes of the present invention (the relative angle of the left side small skeleton and the left side large skeleton is 45 degrees, and the relative angle of the left side large skeleton and the first connecting rod is 45 degrees)

As shown in FIG. 6, when the second button is pressed, the left side large skeleton 8 and the left side small skeleton 4 are in a state in which relative rotation can occur, rotating the left side small skeleton 4 by an angle of one the fourth tooth so that the relative angle of the left side large skeleton 8 and the left side small skeleton 4 is 45 degrees. Similarly, when the first button 23 is pressed, the left side large skeleton 8 and the first connecting rod 9 are in a state in which relative rotation can occur, rotating the left side large skeleton 8 by an angle of one the second tooth 46 so that the relative angle of the left side large skeleton 8 and the first connecting rod 9 is 45 degrees.

Figure 7:
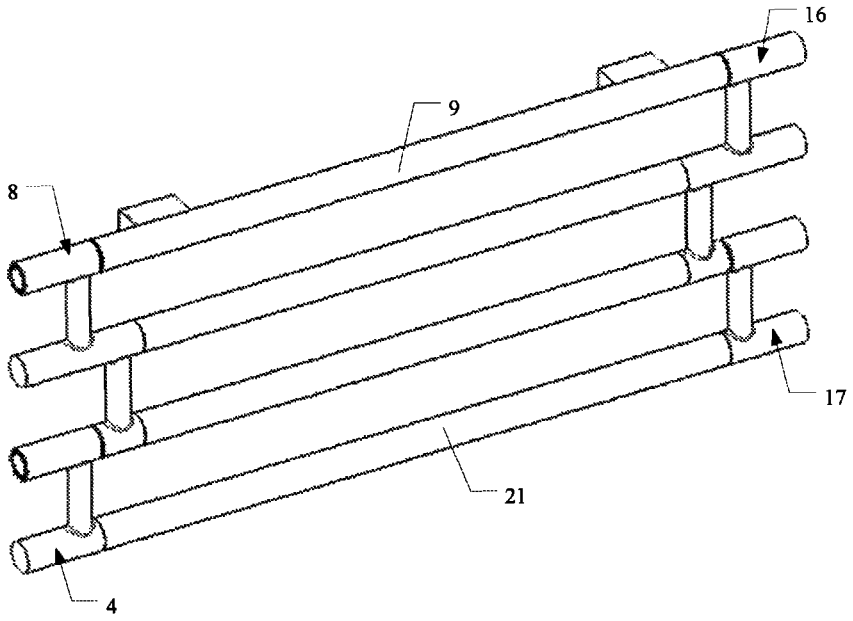
FIG. 7 is a morphology view of a fourth rotation position of the towel rack with multiple usage modes of the present invention (the relative angle of the left side small skeleton and the left side large skeleton is 0 degree, and the relative angle of the left side large skeleton and the first connecting rod is 90 degrees)

As shown in FIG. 7, when the first button 23 is pressed, the left side large skeleton 8 and the first connecting rod 9 are in a state in which relative rotation can occur, rotating the left side large skeleton 8 by an angle of two the second tooth 46 so that the relative angle of the left side large skeleton 8 and the first connecting rod 9 is 90 degrees.

As shown in FIG. 13(*a*) and FIG. 13(*b*), in a preferred embodiment, the towel rack with multiple usage modes, the left end face of the first cam 13 has four annularly arranged first convex feet 50, the left end face of the second cam 38 has four annularly arranged second convex feet 52, the right end face of the first concave wheel 14 has four annularly arranged third convex feet, and the right end face of the second concave wheel 39 has four annularly arranged fourth convex feet; the interior of the first connecting rod 9 having four annularly arranged first grooves, the interior of the first upper rod 32 of the right side large skeleton 16 having four annularly arranged second grooves, the interior of the first lower rod 34 of the right side large skeleton 16 having four annularly arranged third grooves, the interior of the second upper rod 42 of the right side small skeleton 17 having four annularly arranged fourth grooves; wherein the first convex feet 50 and the first grooves are fixed to each other, the second convex feet 52 and the second grooves are fixed to each other, the third convex feet and the third grooves are fixed to each other, and the fourth convex feet and the fourth grooves are fixed to each other.

The present embodiment can prevent the first cam 13 rotating freely with respect to the first connecting rod 9, prevent the first concave wheel 14 rotating freely with respect to the right side large skeleton 16, prevent the second cam 38 rotating freely with respect to the right side large skeleton 16, and prevent the second concave wheel 39 rotating freely with respect to the right side small skeleton 17. The present embodiment contributes to improvement of stability of the towel frame structure.

Figure 8:
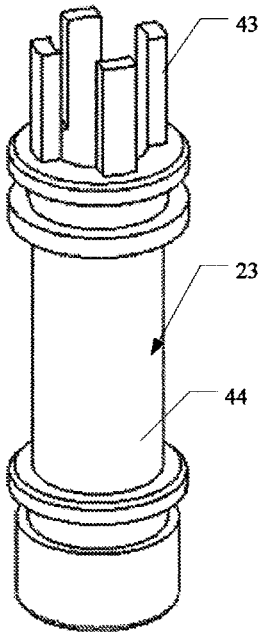
FIG. 8 is a part view of the first button of the towel rack with multiple usage modes of the present invention.

As shown in FIG. 8 and FIG. 9, in a preferred embodiment, the towel rack with multiple usage modes, the first button 23 includes a first body 23 and four fifth convex feet 43 connected to the right side of the first body 23, and when the first button 23 is pressed, the fifth convex feet 43 slides along a through groove opened on the inside of the left side large skeleton 8, and the fifth convex feet 43 abutting against the first positioning wheel 27, the second button 2 including a second body and four sixth convex feet connected to the right side of the second body, and when the second button 2 is pressed, the sixth convex feet slides along a through groove opened on the inside of the left side small skeleton 4, and the sixth convex feet abutting against the second positioning wheel 6.

When the first button 23 is pressed, the first button 23 pushes the first positioning wheel 27 through the fifth convex feet 43 and the first button 23 moves toward the first connecting rod 9, the fifth convex feet 43 sliding along the through groove 45 opened on the inside of the left side large skeleton 8, which can prevent the first button 23 rotating freely and affect adjustment of the relative angles of the left side large skeleton 8 and the first connecting rod 9, and also improve stability of the towel frame structure. Similarly, When the second button 2 is pressed, the second button 2 pushes the second positioning wheel 6 through the sixth convex feet and the second button 2 moves toward the left side large skeleton 8, the sixth convex feet sliding along the through groove opened on the inside of the left side small skeleton 4, which can prevent the second button 2 rotating freely and also improve stability of the towel frame structure.

As shown in FIG. 1 to FIG. 4, in a preferred embodiment, the towel rack with multiple usage modes, also contains: a first nut 22 provided at the left end of the first upper rod 53 of the left side large skeleton 8 for stopping the first button 23, a second nut 1 provided at the left end of the second upper rod 19 of the left side small skeleton 4 for stopping the second button 2. That is, the first nut 22 is sheathed at the head of the first button 23, and the first nut 22 can prevent the first button 23 from coming off when the first button 23 is reset by the action of the first return spring 28. When the first button 23 needs to be operated, an intermediate screw hole of the first nut 22 can be realized.

Figure 12:
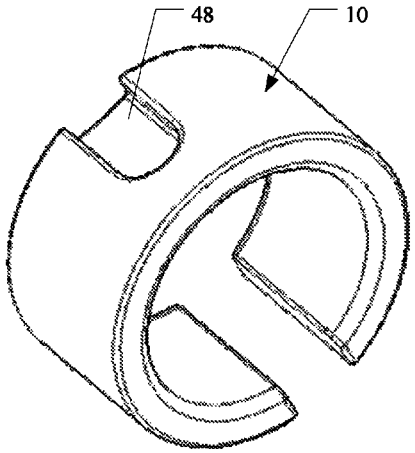
FIG. 12 is a part view of the first opening gasket of the towel rack with multiple usage modes of the present invention.

As shown in FIG. 3, FIG. 4 and FIG. 12, in a preferred embodiment, the towel rack with multiple usage modes, the first limit screw 12 is sheathed with a first opening gasket 10 opening a first arcuate groove 48, the opening direction of the first arcuate groove 48 being directed toward the left, a first fastening bolt 11 being connected to the first upper rod 32 of the right side large skeleton 16 and passing upwardly through the first arcuate groove 48; the second limit screw 37 being sheathed with a second opening gasket 35 opening a second arcuate groove, the opening direction of the second arcuate groove being directed toward the left, a second fastening bolt 36 being connected to the second upper rod 42 of the right side small skeleton 17 and passing upwardly through the second arcuate groove.

Wherein the first fastening bolt 11 is connected to the right side large skeleton 16 and passes through the first arcuate groove 48 of the first opening gasket 10, that is, the first fastening bolt 11 is stopped of the closed end of the first arcuate groove 48, and ensure that the right side large skeleton 16 can not be separated from the first connecting rod 9. The second fastening bolt 36 is connected to the right side small skeleton 17 and passes through the second arcuate groove of the second opening gasket 35, that is, the second fastening bolt 36 is stopped of the closed end of the second arcuate groove, and ensure that the right side small skeleton 17 can not be separated from the right side large skeleton 16.

Figure 11:
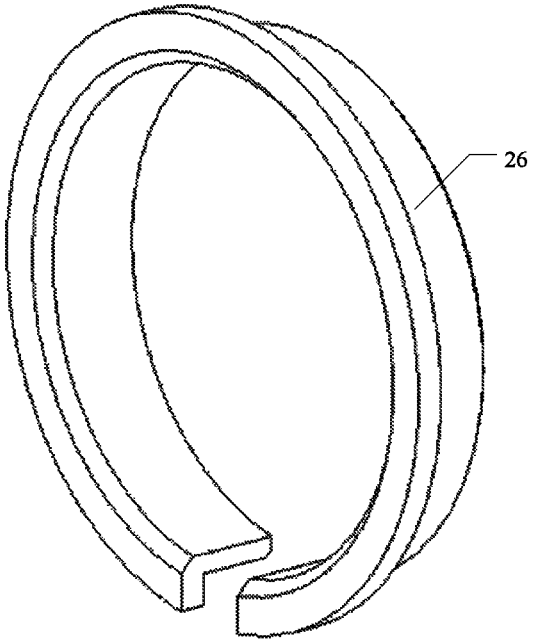
FIG. 11 is a part view of a first opening bush of the towel rack with multiple usage modes of the present invention.

In addition, FIG. 11 also shows a structural view of the first opening bush 26. The first opening bush 26 is provided between the first upper rod 53 of the left side large skeleton 8 and the first connecting rod 9. The second opening bush 5 is provided between the second upper rod 19 of the left side small skeleton 4 and the second lower rod 20 of the left side large skeleton 8.

In a preferred embodiment, the towel rack with multiple usage modes, the left side large skeleton 8, the left side small skeleton 4, the right side large skeleton 16, and the right side small skeleton 17 are integrally formed. Although the embodiments of the present invention have been disclosed above, they are not limited to the applications previously mentioned in the specification and embodiments, and can be applied in various fields suitable for the present invention. For ordinary skilled person in the field, other various changed model, formula and parameter may be easily achieved without creative work according to instruction of the present invention, changed, modified and replaced embodiments without departing the general concept defined by the claims and their equivalent are still included in the present invention. The present invention is not limited to particular details and illustrations shown and described herein.

What is claimed is:

1. A towel rack with multiple usage modes, comprises:

a first connecting rod;

a second connecting rod;

a pair of large skeletons, each large skeleton including a first upper rod and a first lower rod, wherein the first upper rod of the left side large skeleton is connected to the left side of the first connecting rod by a first rotation positioning member, and the first upper rod of the right side large skeleton is connected to the right side of the first connecting rod through a second rotation positioning member, and wherein both ends of the left side large skeleton are penetrated, a first button provided in the inside of the left side large skeleton, and the first button being arranged in such a manner that the pair of large skeletons and the first connecting rod are in a state in which relative rotation can occur when the first button are pressed, and the pair of large skeletons is in a locked state with the first connecting rod when the first button is released;

a pair of small skeletons, each small skeleton including a second upper rod and a second lower rod, wherein the second upper rod of the left side small skeleton is connected to the left side of the first lower rod of the left side large skeleton by a third rotation positioning member, and the second upper rod of the right side small skeleton is connected to the right side of the first lower rod of the right side large skeleton through a fourth rotation positioning member, and the second connecting rod being fixedly connected between the second lower rod of the pair of small skeletons, wherein both ends of the left side small skeleton are penetrated, a second button provided in the inside of the left side small skeleton, and the first button being arranged in such a manner that the pair of small skeletons and the pair of large skeletons are in a state in which relative rotation can occur when the second button are pressed, and the pair of small skeletons is in a locked state with the pair of large skeletons when the second button is released;

wherein, the first rotation positioning member comprising:

a first tooth formed on an inner wall of the first connecting rod;

a second tooth formed on an inner wall of the first upper rod of the left side large skeleton;

a first screw hole formed in the interior of the first connecting rod;

a first connecting screw having one end extending into the inside of the first upper rod of the left side large skeleton and the other end threadedly connecting to the first screw hole;

a first positioning wheel slidably fitted on the first connecting screw, and the first positioning wheel having a third tooth engaging with the first tooth and the second tooth, the first positioning wheel abuting against the first button;

a first return spring sheathed on the first connecting screw, one end of the first return spring connecting to the first positioning wheel and the other end connecting to the inner wall of the first connecting rod;

the second rotation positioning member comprising:

a second screw hole formed in the interior of the first upper rod of the right side large skeleton;

a first limit screw having one end extending into the interior of the first connecting rod and the other end threadedly connecting to the second screw hole;

a first cam having a first end face tooth, a first concave wheel having a second end face tooth, the first cam and the first concave wheel being engaged with each other, and the first cam and the first concave wheel slidably fitting on the first limit screw, wherein the first cam is provided in the first connecting rod, and the first concave wheel is disposed inside the first upper rod of the right side large skeleton;

a second return spring which is sheathed on the first limit screw, and having one end connecting to the first concave wheel and the other end connecting to the first upper rod of the right side large skeleton;

when the first button is pressed, the first positioning wheel moving in the direction of the first connecting rod until separating from the second tooth so that the left side large skeleton and the first connecting rod are in a state in which relative rotation can occur, and the first concave wheel moving in the direction of the right side large skeleton by the action of the first connecting rod so that the first concave wheel and the first cam are disengaged from each other, so that the right side large skeleton and the first connecting rod are in a state in which relative rotation can occur;

when the first button is released, the first positioning wheel moving in the direction of the left side large skeleton by the elastic force of the first return spring until it is simultaneously engaged with the first tooth and the second tooth, so that the left side large skeleton is in a locked state with the first connecting rod, and the first concave wheel moving in the direction of the first connecting rod by the elastic force of the second return spring until the first concave wheel and the first cam are engaged with each other so that the right side large skeleton is in a locked state with the first connecting rod.

2. The towel rack with multiple usage modes according to claim 1, being characterized in that, the third rotation positioning member contains:

a fourth tooth formed on an inner wall of the second upper rod of the left side small skeleton;

a fifth tooth formed on an inner wall of the first lower rod of the left side large skeleton;

a third screw hole formed in the interior of the second upper rod of the left side small skeleton;

a second connecting screw having one end extending into the inside of the first lower rod of the left side large skeleton and the other end threadedly connecting to the third screw hole;

a second positioning wheel slidably fitted on the second connecting screw, and the second positioning wheel having a sixth tooth engaging with the fourth tooth and the fifth tooth, the second positioning wheel abuting against the second button;

a third return spring sheathed on the second connecting screw, one end of the third return spring connecting to the second positioning wheel and the other end connecting to an inner wall of the first lower rod of the left side large skeleton;

the fourth rotation positioning member comprising:

a fourth screw hole formed in the interior of the second upper rod of the right side small skeleton;

a second limit screw having one end extending into the interior of the first lower rod of the right side large skeleton and the other end threadedly connecting to the fourth screw hole;

a second cam having a third end face tooth, a second concave wheel having a fourth end face tooth, the second cam and the second concave wheel being engaged with each other, and the second cam and the second concave wheel slidably fitting on the second limit screw, wherein the second cam is provided in the right side large skeleton, and the second concave wheel is disposed inside the second upper rod of the right side small skeleton;

a fourth return spring which is sheathed on the second limit screw, and having one end connecting to the second concave wheel and the other end connecting to the second upper rod of the right side small skeleton;

when the second button is pressed, the second positioning wheel moving in the direction of the left side large skeleton until separating from the fifth tooth so that the left side large skeleton and the left side small skeleton are in a state in which relative rotation can occur, and the second concave wheel moving in the direction of the right side small skeleton by the action of the second connecting rod so that the second concave wheel and the second cam are disengaged from each other, so that the right side large skeleton and the right side small skeleton are in a state in which relative rotation can occur;

when the second button is released, the second positioning wheel moving in the direction of the left side small skeleton by the elastic force of the third return spring until it is simultaneously engaged with the fourth tooth and the fifth tooth, so that the left side large skeleton is in a locked state with the left side small skeleton, and the second concave wheel moving in the direction of the right side large skeleton by the elastic force of the fourth return spring until the second concave wheel and the second cam are engaged with each other so that the right side large skeleton is in a locked state with the right side small skeleton.

3. The towel rack with multiple usage modes according to claim 2, being characterized in that, the outer circumference of the first positioning wheel is annularly arranged with eight third teeth, and the outer circumference of the second positioning wheel is annularly arranged with eight sixth teeth, and the right end face of the first cam having eight first end face teeth with an annular arrangement, the left end face of the first concave wheel having eight second end face teeth with an annular arrangement, the right end face of the second cam having eight third end face teeth with an annular arrangement, and the right end face of the second concave wheel having eight fourth end face teeth with an annular arrangement.

4. The towel rack with multiple usage modes according to claim 3, being characterized in that, the left end face of the first cam has four annularly arranged first convex feet, the left end face of the second cam has four annularly arranged second convex feet, the right end face of the first concave wheel has four annularly arranged third convex feet, and the right end face of the second concave wheel has four annularly arranged fourth convex feet; the interior of the first connecting rod having four annularly arranged first grooves, the interior of the first upper rod of the right side large skeleton having four annularly arranged second grooves, the interior of the first lower rod of the right side large skeleton having four annularly arranged third grooves, the interior of the second upper rod of the right side small skeleton having four annularly arranged fourth grooves; wherein the first convex feet and the first grooves are fixed to each other, the second convex feet and the second grooves are fixed to each other, the third convex feet and the third grooves are fixed to each other, and the fourth convex feet and the fourth grooves are fixed to each other.

5. The towel rack with multiple usage modes according to claim 4, being characterized in that, the first button includes a first body and four fifth convex feet connected to the right side of the first body, and when the first button is pressed, the fifth convex feet sliding along a through groove opened on the inside of the left side large skeleton, and the fifth convex feet abutting against the first positioning wheel, the second button including a second body and four sixth convex feet connected to the right side of the second body, and when the second button is pressed, the sixth convex feet sliding along a through groove opened on the inside of the left side small skeleton, and the sixth convex feet abutting against the second positioning wheel.

6. The towel rack with multiple usage modes according to claim 2, being characterized in that, also contains:

a first nut provided at the left end of the first upper rod of the left side large skeleton for stopping the first button;

a second nut provided at the left end of the second upper rod of the left side small skeleton for stopping the second button.

7. The towel rack with multiple usage modes according to claim 2, being characterized in that, the first limit screw is sheathed with a first opening gasket opening a first arcuate groove, the opening direction of the first arcuate groove being directed toward the left, a first fastening bolt being connected to the first upper rod of the right side large skeleton and passing upwardly through the first arcuate groove; the second limit screw being sheathed with a second opening gasket opening a second arcuate groove, the opening direction of the second arcuate groove being directed toward the left, a second fastening bolt being connected to the second upper rod of the right side small skeleton and passing upwardly through the second arcuate groove.

8. The towel rack with multiple usage modes according to claim 1, being characterized in that, the left side large skeleton, the left side small skeleton, the right side large skeleton, and the right side small skeleton are integrally formed.

* * * * *